US011396855B2

(12) United States Patent
Kerss et al.

(10) Patent No.: US 11,396,855 B2
(45) Date of Patent: Jul. 26, 2022

(54) SPACER FOR USE IN AN AIR INTAKE SYSTEM OF AN INTERNAL COMBUSTION CHAMBER

(71) Applicant: Perkins Engines Company Limited, Peterborough (GB)

(72) Inventors: Geoffrey Kerss, Peterborough (GB); Owen Daniel Else, Peterborough (GB); Jonathan Charles Scott, Bourne (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 17/218,424

(22) Filed: Mar. 31, 2021

(65) Prior Publication Data

US 2021/0301771 A1 Sep. 30, 2021

(30) Foreign Application Priority Data

Mar. 31, 2020 (GB) ..... 2004712

(51) Int. Cl.
*F02M 35/10* (2006.01)
*F02M 35/104* (2006.01)

(52) U.S. Cl.
CPC .... *F02M 35/104* (2013.01); *F02M 35/10242* (2013.01)

(58) Field of Classification Search
CPC ..... F02M 35/104; F02M 35/10242; F02M 35/10295; F02M 35/10308; F02M 35/10085; F02M 35/10; F02M 35/10026
See application file for complete search history.

(56) References Cited

U.S. PATENT DOCUMENTS

| | | | | |
|---|---|---|---|---|
| 4,318,273 | A * | 3/1982 | Nohira | F02M 35/10157 60/611 |
| 4,610,377 | A * | 9/1986 | Rasmussen | G01F 11/06 222/288 |
| 4,768,487 | A | 9/1988 | Yamamoto et al. | |
| 5,261,231 | A | 11/1993 | Huh | |
| 6,895,948 | B2 | 5/2005 | Mori et al. | |
| 7,523,730 | B2 | 4/2009 | Wilson | |
| 2009/0029383 | A1 | 1/2009 | Densham | |
| 2009/0056664 | A1 | 3/2009 | Netser | |
| 2011/0098463 | A1* | 4/2011 | Yoshitani | C08B 11/20 536/32 |

(Continued)

FOREIGN PATENT DOCUMENTS

| | | | |
|---|---|---|---|
| CN | 204327347 U | | 5/2015 |
| CN | 206583142 U | * | 10/2017 |

(Continued)

OTHER PUBLICATIONS

Great Britain Search Report related to Application No. 2004712.2; reported on Jul. 23, 2020.

*Primary Examiner* — Joseph J Dallo

(57) ABSTRACT

The present invention refers to a spacer for use in an air intake system of an internal combustion engine for delimiting an intake duct between an intake manifold and a cylinder head of the engine, wherein the spacer is provided with at least one flow-through passage and at least one air-accumulation cavity which are fluid-communicatively connected and constitute the intake duct.

15 Claims, 2 Drawing Sheets

(56) References Cited

U.S. PATENT DOCUMENTS

| | | | | |
|---|---|---|---|---|
| 2011/0107753 | A1* | 5/2011 | Leroy | F01N 13/10 60/323 |
| 2017/0191454 | A1* | 7/2017 | Klyczek | F02M 35/10216 |
| 2019/0078518 | A1 | 3/2019 | Yamase et al. | |

FOREIGN PATENT DOCUMENTS

| | | | |
|---|---|---|---|
| EP | 2131024 | A2 | 12/2009 |
| GB | 2136501 | A | 9/1984 |
| JP | 2001198549 | * | 7/2001 |
| JP | 2004183484 | A | 7/2004 |
| JP | 2004270588 | A | 9/2004 |

* cited by examiner

SPACER FOR USE IN AN AIR INTAKE SYSTEM OF AN INTERNAL COMBUSTION CHAMBER

CROSS-REFERENCE TO RELATED APPLICATION

This application claims priority under 35 USC § 119 and the Paris Convention to Great Britain Patent Application 2004712.2 filed on Mar. 31, 2020.

TECHNICAL FIELD

The present invention refers to a spacer for use in an air intake system of an internal combustion chamber and to an internal combustion engine which is equipped with such a spacer.

TECHNOLOGICAL BACKGROUND

Internal combustion engines, such as reciprocating engines, are equipped with an air intake system for receiving, processing, and guiding fresh intake air into combustion chambers of the engine. As internal combustion engines usually comprise a plurality of cylinders, each of which accommodates one combustion chamber, known air intake systems typically divide intake air into a corresponding number of separate or partial intake air streams which are guided into one of the combustion chambers, respectively. For doing so, the air intake system is equipped with an intake manifold configured for dividing an air intake stream into the plurality of separate air intake streams before being directed into the cylinder.

For properly mounting the intake manifold to an engine block of the engine accommodating the plurality of cylinders, the use of spacers is known which are interposed between the intake manifold and the engine block and provide an airtight connection between these components.

However, during operation of the engine, e.g. upon actuation of an air intake valve, vibrations and pressure waves may be generated in the air intake system which may propagate from the air intake valve in an upstream direction through the air intake system, i.e. an intake duct thereof. As a result, e.g. by causing resonances in the air intake passage, the flow of intake air through the intake duct and thus the supply of intake air into the combustion chamber may be affected, thereby causing, for example, pollutant emissions of the engine, such as nitrogen oxides or particulate matter.

SUMMARY OF THE INVENTION

Starting from the prior art, it is an objective to provide a solution for preventing an air intake system of an internal combustion engine from being subjected to a disturbed flow of intake air through its intake passage.

This objective is solved by means of a spacer for use in an air intake system of an internal combustion engine and an internal combustion engine according to the independent claims. Preferred embodiments are set forth in the present specification, the Figures as well as the dependent claims.

Accordingly, a spacer for use in an air intake system of an internal combustion engine is provided. The spacer is intended and designed for delimiting an intake duct between an intake manifold and a cylinder head of the engine and is provided with at least one flow-through passage and at least one air-accumulation cavity which are fluid-communicatively connected and constitute the intake duct.

Furthermore, an internal combustion engine is provided which has an air intake system being equipped with a spacer as described above.

Since the internal combustion engine is equipped with the above-described spacer, technical features which are described in connection with the spacer in the present disclosure may also relate and be applied to the proposed internal combustion engine, and vice versa.

BRIEF DESCRIPTION OF THE DRAWINGS

The present disclosure will be more readily appreciated by reference to the following detailed description when being considered in connection with the accompanying drawings in which.

DETAILED DESCRIPTION OF PREFERRED EMBODIMENTS

Figure 1:
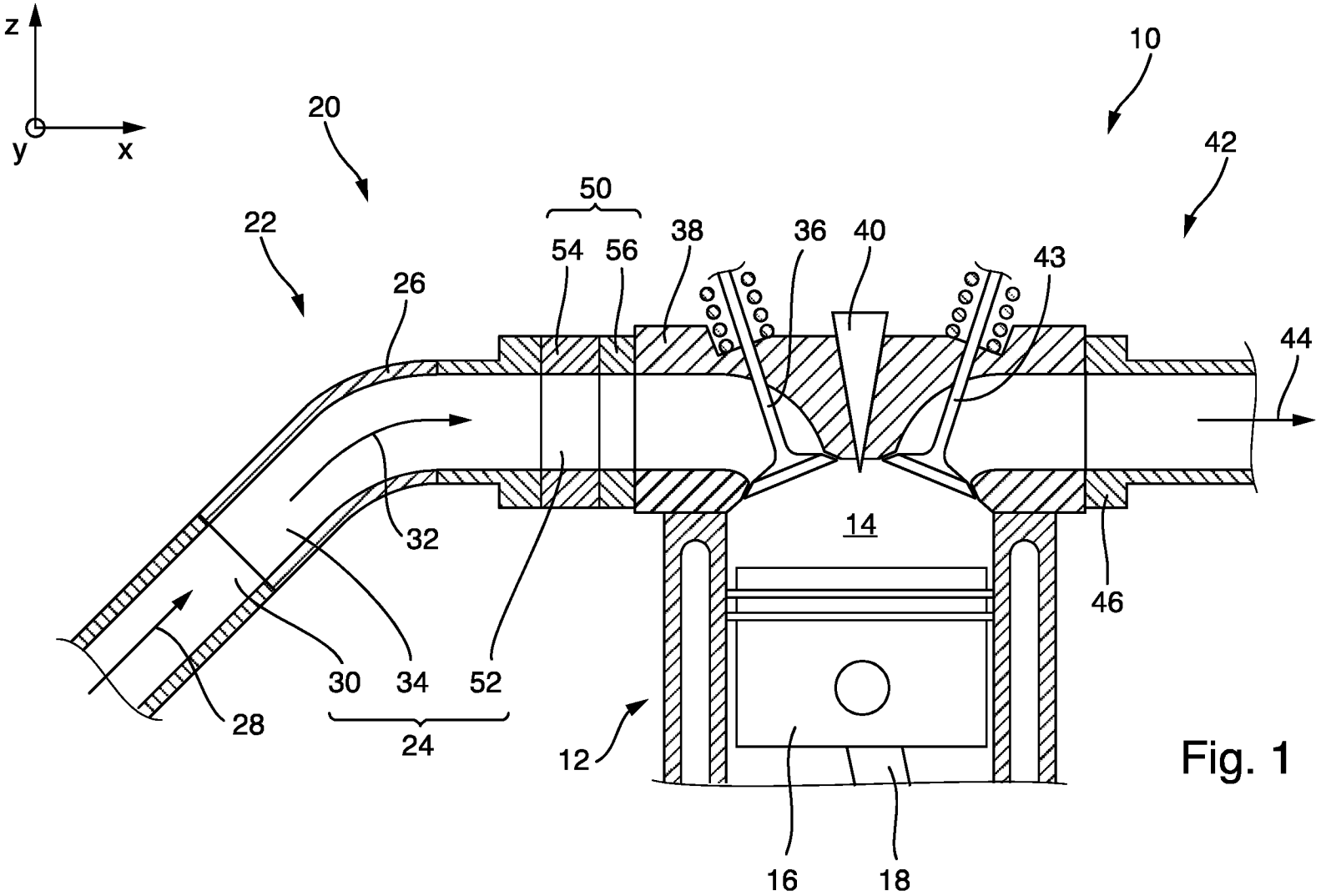
FIG. 1 schematically shows a sectional view of an internal combustion engine which is equipped with a spacer for mounting an intake manifold to a cylinder head of the engine.

In the following, the invention will be explained in more detail with reference to the accompanying Figures. In the Figures, like elements are denoted by identical reference numerals and repeated description thereof may be omitted in order to avoid redundancies.

FIG. 1 schematically shows a sectional view of an internal combustion engine 10, also referred to as "the engine" in the following, which is provided in the form of a reciprocating engine, such as a diesel engine. The engine 10 may be installed in a vehicle, e.g. a vessel, as a main or auxiliary engine. Alternatively, the engine 10 may be used in power plants.

In the shown configuration, the engine 10 comprises at least one cylinder 12, preferably three cylinders 12, but may also comprise more or less than three cylinders 12. Each cylinder 12 is provided with a combustion chamber 14 which is delimited by an inner wall of the cylinder 12 and a piston 16 accommodated in the cylinder 12. The piston 16 is configured for reciprocatingly moving within the cylinder 12 and is connected to a crankshaft (not shown) of the engine 10 via a connecting rod 18.

During operation of the engine 10, each one of the combustion chambers 14 is supplied with a fuel mixture which is to be ignited therein so as to produce high-temperature and high-pressure gases which apply forces to and thus axially move the associated pistons 16, thereby rotating the crankshaft of the engine 10. In this way, chemical energy is transformed into mechanical energy.

The fuel mixture to be supplied to and ignited in the combustion chambers 14 is formed by mixing a fuel medium, i.e. diesel fuel, with intake air, i.e. comprising fresh air or ambient air from outside the vehicle.

For supplying intake air into each one of the combustion chambers 14, the engine 10 comprises an air intake system 20 which is configured to collect air from outside the vehicle, to process the thus received air, e.g. by loading or pressurizing it using a turbocharger and/or by mixing it with exhaust gas from the engine, and to guide it into the combustion chambers 14. In the context of the present disclosure, the term "intake air" refers to a gas or gas stream which is provided by the air intake system 20 to be supplied into the combustion chamber 14 so as to form the fuel mixture. Typically, intake air comprises fresh air from outside the vehicle. Additionally, intake air may comprise exhaust gas which may be recirculated from an exhaust passage of the engine 10 into the air intake system 20.

More specifically, the air intake system 20 comprises an intake passage 22 which forms an intake duct 24 through which intake air flows prior to being feed into the combustion chambers 14. In the context of the present disclosure, the term "intake duct" refers to a flow section or flow passage through which intake air is passed and guided prior to being discharged into the combustion chamber 14.

For supplying intake air into the different combustion chambers 14, the intake passage 22 comprises an intake manifold 26 which is configured to divide a common intake air stream 28 flowing through a common flow passage 30 of the intake passage 22 into separate and partial intake air streams 32, each of which is guided to an associated one of the combustion chambers 14 via separate flow passages 34 of the intake manifold 26. In other words, each one of the separate flow passages 34 of the intake manifold 26 is associated to one of the plurality of combustion chambers 14 and configured to direct one separate intake air stream 32 thereinto.

Each one of the cylinders 12 is provided with an intake air valve 36 which is configured to selectively direct and thus to variedly adjust the supply of intake air into the combustion chamber 14. Each intake air valve 36 is provided in a cylinder head 38 and arranged at a downstream end of the intake duct 24, i.e. of the corresponding separate flow passage 34.

In the context of the present disclosure, the terms "downstream" and "upstream" refer to a flow direction of gases within the engine 10, i.e. a flow direction of intake air flowing through the intake passage 24.

To that end, for supplying the fuel medium into the combustion chamber 14, each cylinder 12 is provided with a fuel injection valve or pump 40 which is arranged in the cylinder head 38 and provided for variedly injecting the fuel medium into the combustion chamber 14. In an alternative configuration of the engine, the fuel medium may be injected into the intake duct, i.e. the separate flow passages 34, before being supplied to the combustion chamber 14.

The combustion chamber 14 of each cylinder 12 is further connected to an exhaust passage 42 for expelling combustion gases from the combustion chamber 14, i.e. after combustion of the fuel mixture took place. For controlling the expelling of combustion gases, each cylinder 12 is provided with an exhaust gas valve 43 which is configured for variedly and selectively expelling exhaust gases from the associated combustion chamber 14 into the exhaust passage 42. Exhaust gases are separately expelled from the combustion chambers 14 and are merged to a common exhaust gas stream 44 flowing through the exhaust passage 42 by means of an outtake manifold 46 which is arranged downstream of the combustion chamber 14.

The basic structure and function of such an internal combustion engine 10 and its components are well known to a person skilled in the art and are thus not further specified. Rather, characteristics of the engine's air intake system 20 which are interlinked with the present invention are addressed in the following. The skilled person will understand that, although not further specified in the present disclosure, the internal combustion engine 10 may be equipped with further components, such as a turbocharger, an air intake filter, an exhaust gas recirculation system, etc.

For properly connecting the intake manifold 26 to an engine block of the engine 10, in particular the cylinder head 38, the air intake system 20 is equipped with a spacer 50 which, in a mounted state of the engine 10, is disposed between the intake manifold 26 and the cylinder head 38. In this way, intake air flowing through the intake duct 24 is successively guided through the intake manifold 26, the spacer 50 and the cylinder head 38 before being discharged into the combustion chamber 14 via the intake air valve 36. More specifically, upon flowing through the intake passage 22, the common intake air stream 28 is, at first, guided through the common flow passage 30 and thereby is directed into the intake manifold 26. Upon flowing through the intake manifold 26, the common intake air stream 28 is then divided into the separate intake air streams 32, each of which is directed into the associated one of the plurality of cylinders 12 via the associated separate flow passage 34. By doing so, i.e. upon flowing through the separate flow passage 34, the separate intake air stream 32 successively passes through the intake manifold 26, the spacer 50 and the cylinder head 38. In other words, the intake manifold 26, the spacer 50 and the cylinder head 38 form and delimit successively arranged flow sections of the intake duct 24, in particular the separate flow passage 34.

Accordingly, the provided spacer 50 is designed and configured to delimit the intake duct 24, in particular a flow section of the intake duct 24, between the intake manifold 26 and the cylinder head 38. Thus, as can be gathered from FIG. 1, the spacer 50 fluid-communicatively connects a flow section of the intake duct 24 provided in the intake manifold 26 with another flow section of the intake duct 24 provided in the cylinder head 38. In other words, the intake duct 24 forms a flow passage of intake air which extends through the intake passage 22, the spacer 50 and the cylinder head 38. Accordingly, the intake duct 24 is formed by the intake passage 22, the spacer 50 and the cylinder head 38.

For doing so, the spacer 50 is provided with a plurality of flow-through passages 52 each of which is associated to one of the separate flow passages 34, respectively. In other words, each one of the flow passages 52 forms a part of the intake duct 24, in particular a part of the associated separate flow passage 34. Accordingly, the spacer 50 comprises a number of flow-through passages 52 which corresponds to the number of separate flow passages 34 of the intake manifold 26.

In the shown configuration, the spacer 50 is provided as a multi-piece part which comprises or consists of a spacer plate 54 and a gasket 56. In other words, the spacer 50 is provided in the form of an assembly unit. In an alternative configuration, the spacer may be provided as a one-piece or integral part.

As can be gathered from FIG. 1, the spacer plate 54 and the gasket 56 are arranged one after the other, in particular directly one after the other. Accordingly, upon flowing through the spacer 50, i.e. its flow-through passage 52, intake air is subsequently guided through the spacer plate 54 and the gasket 56. Thus, each one of the flow-through passages 52 is formed by both the spacer plate 54 and the gasket 56.

In the shown configuration, the gasket 56 is interposed between the spacer plate 54 and the engine head 38. Alternatively, the spacer 50 may be provided such that intake air, upon flowing through the flow-through passage 52 is, at first, guided through the gasket 56 and then through the spacer plate 54. Accordingly, the gasket 56 may be interposed between the spacer plate 54 and the intake manifold 26. Alternatively or additionally, the spacer 50 may be provided with a further gasket such that the spacer plate 52 is interposed between the gasket 56 and the further gasket.

According to this configuration, each one of the flow-through passages may be formed or delimited by the spacer plate 54, the gasket 56 and the further gasket.

Figure 2:
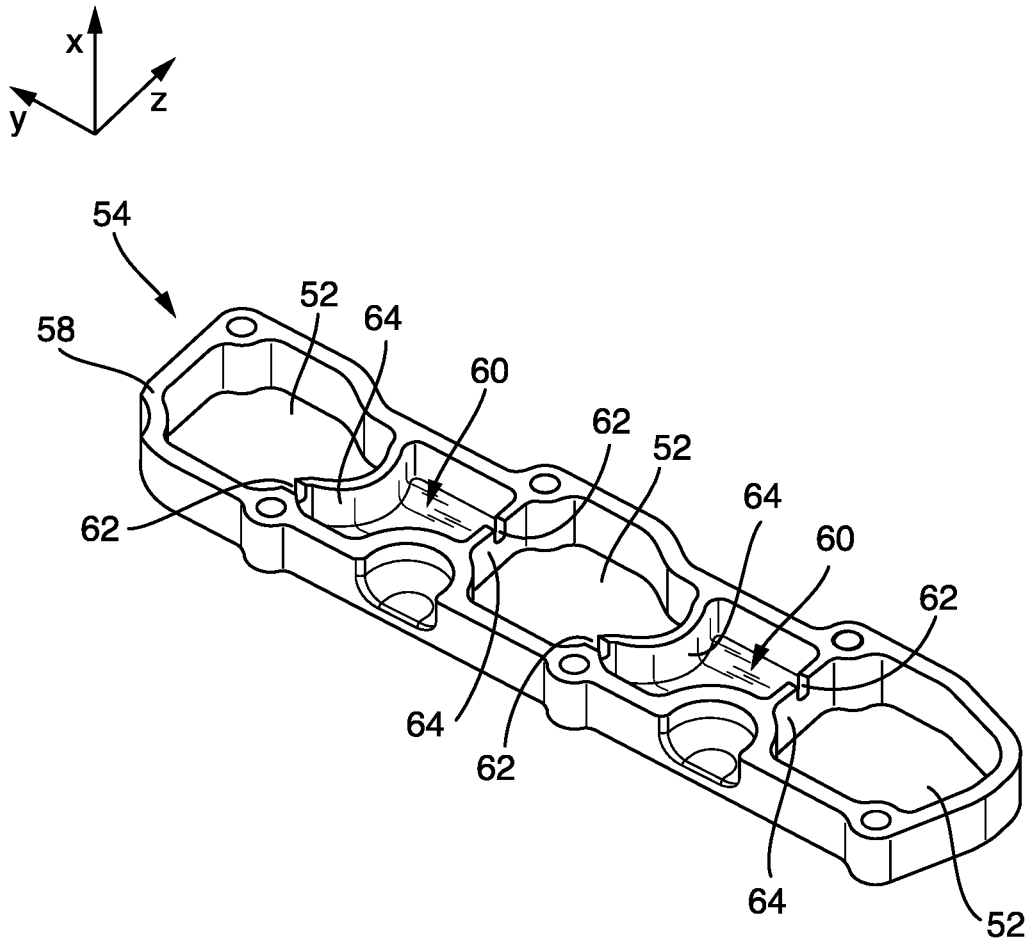
FIG. 2 schematically shows a perspective view of a spacer plate used in the spacer depicted in FIG. 1.

FIG. 2 shows a perspective view of the spacer plate 54 in a disassembled state in which the spacer plate 54 is disassembled from the spacer 50. Specifically, FIG. 2 provides a perspective view onto a front surface 58 of the spacer plate 54 which is configured to be mounted to and to get in contact with a correspondingly designed front surface of the gasket 56. In other words, in an assembled state of the spacer 50 in which the spacer plate 54 and the gasket 56 are mounted to one another, the front surface 58 of the spacer plate 54 is connected to and fit tightly against the correspondingly designed front surface of the gasket 56.

As can be gathered from FIG. 2, the spacer plate 54 and thus the spacer 50 are provided with three flow-through passages 52 each of which is associated to one separate flow passage 34 and thus to one cylinder 12 of the engine 10. The flow-through passages 52 are provided with a cross-sectional shape which is designed correspondingly to a cross-sectional shape of the intake duct 24 provided in the intake manifold 26, i.e. the separate flow passages 34, and in the cylinder head 38 so as to ensure a smooth transition of the intake duct among the spacer 50.

Furthermore, the spacer 50 is provided with at least one air-accumulation cavity 60 which is fluid-communicatively connected to at least one of the flow-through passages 52. Specifically, in the shown configuration, the spacer 50 comprises two air-accumulation cavities 60, each of which is fluid-communicatively connected to two of the plurality of flow-through passages 52.

In the context of the present disclosure, the term "air-accumulation cavity" refers to a cavity provided by or in the spacer 50 which is designed and configured such that, in the mounted state of the spacer 50 and during operation of the engine 10, it accumulates intake air, while ensuring that a mass flow of intake air maintains constant or substantially constant upon flowing through the spacer 50. In the following, the air-accommodation cavity 60 is also referred to as "the cavity".

In the provided spacer 50, the flow-through passages 52 and the cavities 60 constitute the intake duct 24, in particular a part of the intake duct 24 delimited by the spacer 50. Specifically, in the shown configuration, each one of the cavities 60 is designed and configured to prevent gases or intake air present in the cavity 60 from being discharged from the intake duct 24. To that end, each one of the cavities 60 is designed and configured to prevent gases from outside the intake duct 24 and the spacer 50 from being supplied into the cavity 60. In other words, each one of the cavities 60 constitutes a section of the intake duct 24 which is hermetically sealed from an outside of the intake duct 24 and the spacer 50.

By such a configuration, the spacer 50 is configured to, in the mounted state and during operation of the engine 10, prevent a mass flow of a gas stream, in particular the air intake stream, flowing through the intake duct 24 from being increased or decreased upon flowing through the spacer 50. Specifically, the spacer 50 is configured such that in each operational state of the engine 10 it prevents that the mass flow of the gas stream flowing through the intake duct 24 is increased or decreased.

During operation of the engine 10, the intake air valves 36 are actuated in accordance with the reciprocating movement of the piston 16 in the associated cylinder 12. In this way, i.e. upon actuation or operation, the intake air valves 36 may generate vibrations or waves, e.g. shockwaves, which propagate from the cylinder head 38 through the intake duct 24 in an upstream direction.

Each one of the cavities 60 is designed such that it is tuned to a frequency of vibrations generated in or waves propagating through the intake duct 24 during operation of the engine 10, e.g. upon actuation of the intake air valves 36. In this way, the cavities 60 may be designed to counteract, attenuate or affect the vibrations or waves propagating through the intake duct 24 during operation. In particular, the cavities 60 may be designed to counteract or attenuate resonances in the air intake system 20 which may be caused by the vibrations or waves propagating through the intake duct 24. In this way, each one of the cavities 60 may form a Helmholtz resonator. For doing so, the cavities 60 are configured and intended for increasing a volume of the intake duct 24. In this way, vibration characteristics, e.g. a natural frequency, of the intake duct 24 and the gas stream flowing therethrough may be affected.

As set forth above, the flow-through passages 52 are fluid-communicatively connected to at least one of the air-accumulation cavities 60. In the configuration depicted in FIG. 2, for doing so, communication conduits 62 are provided which fluid-communicatively connect the cavities 60 to the flow-through passages 52, respectively. Specifically, each one of the communication conduits 62 is provided such that it opens into the flow-through passage 52 in a direction that is substantially perpendicular to a flow direction of intake air to be fed through the flow-through passage 52 in the mounted state. Each one of the communication conduits 62 is provided in a side wall 64 of the spacer plate 54 which is arranged between a flow-through passage 52 and a cavity 60 and in particular delimits a flow-through passage 52 from a cavity 60.

As can be gathered from FIG. 2, each one of the two cavities 60 of the spacer 50 is arranged between and connected to two different flow-through passages 52. Specifically, each one of the two cavities 60 is fluid-communicatively connected to a first flow-through passage 52 by means of a first communication conduit 62 and to a second flow-through passage 52 by means of a second communication conduit 62, wherein the first and the second communication conduit 62 are arranged on opposed sides of the cavity 60. In other words, the first and the second communication conduit 62 are provided in opposed sidewalls 64 of the spacer plate 54.

Alternatively, the spacer 50 may comprise more or less than three flow-through passages 52 and more all less than two cavities 60. For example, the spacer 50 may comprise a number of n flow-through passages 52 and a number of n−1 cavities 60, wherein n is a natural number greater than or equal to two. In such a configuration, each one of the plurality of cavities 60 may be arranged between two different flow-through passages 52.

As set forth above, the spacer 50 in the shown configuration comprises or constitutes the spacer plate 54 and the gasket 56. Specifically, in the shown configuration, the cavity 60 and the communication conduits 62 are delimited by both, the spacer plate 54 and the gasket 56. For doing so, the spacer plate 54 is provided with a plurality of recesses which extend from the front surface 58 of the spacer plate 54 in a thickness direction of the spacer plate 54 and which form the cavities 60 and the communication conduits 62.

It will be obvious for a person skilled in the art that these embodiments and items only depict examples of a plurality of possibilities. Hence, the embodiments shown here should not be understood to form a limitation of these features and configurations. Any possible combination and configuration of the described features can be chosen according to the scope of the invention.

This is particular the case with respect to the following optional features which may be combined with some or all embodiments, items and/or features mentioned before in any technically feasible combination.

Accordingly, a spacer for use in an air intake system of an internal combustion engine may be provided. The spacer may be configured and intended for delimiting an intake duct between an intake manifold and a cylinder head of the engine, wherein the spacer is provided with at least one flow-through passage and at least on air-accumulation cavity which are fluid-communicatively connected and constitute the intake duct.

By being provided with the air-accumulation cavity, flow and vibration characteristics of the intake duct may be affected so as to counteract or suppress unfavorable vibration or wave propagation phenomena occurring during operation of the engine.

It has been found that, during operation of the engine, an intake air valve configured for selectively injecting fresh air flowing through the intake duct into an engine's combustion chamber may induce vibrations or waves, e.g. shockwaves, which propagate therefrom in a flow upstream direction through the intake duct. These vibrations or waves, however, may induce resonances or other unfavorable vibration or wave phenomena which may affect flow of intake air through the intake duct and thus may disturb proper supply of intake air into the combustion chamber. Accordingly, by being provided with the at least one air-accumulation cavity, the suggested spacer may purposefully change the volume of the intake duct so as to change flow and/or vibration characteristics thereof, thereby affecting, in particular suppressing or counteracting, propagation of vibrations or waves through the intake duct.

The proposed spacer may be used and employed in an air intake system of any suitable internal combustion engine, in particular reciprocating engine, such as a diesel engine, a gas engine or dual fuel engine. For example, such an internal combustion engine may be utilized or be installed in vehicles, e.g. as main or auxiliary engines, or in power plants.

According to one configuration, the spacer may be provided as a separate part, i.e. which is provided separately from the intake passage, i.e. the intake manifold, and the cylinder head. Accordingly, the spacer may be detachably attached to the intake manifold and the cylinder head. However, the present invention is not limited to this configuration. Rather, the spacer, at least partly, may be provided in, in particular integrally provided, i.e. may at least partly form an integral part together with, the intake manifold and/or the cylinder head. Accordingly, in a further development, the at least one air-accumulation cavity may be provided or machined into an upstream end of the cylinder head which is closed off with a gasket provided between the cylinder head and the intake manifold. In this configuration, the gasket together with the upstream end section of the cylinder head constitute the spacer in the sense of the present disclosure. Alternatively or additionally, the air-accumulation cavity provided or machined into the upstream end of the cylinder head may be sealed or closed off with a correspondingly designed front surface of the intake manifold. In a further development, the front surface of the intake manifold may be provided with a recess which constitutes a part of the air-accumulation cavity. In this configuration, the downstream end of the intake manifold and the upstream end of the cylinder head constitute the spacer in the sense of the present disclosure. Alternatively or additionally, the at least one air-accumulation cavity may be provided or machined into the downstream end of the cylinder head which is closed off with a gasket provided between the cylinder head and the intake manifold. In this configuration, the gasket together with the upstream end section of the cylinder head constitute the spacer in the sense of the present disclosure.

As set forth above, the spacer may be used to delimit an intake duct, in particular a part of the intake duct, between the intake manifold and the cylinder head of the engine. In this way, the spacer may be employed to fluid-communicatively connect the intake manifold to the cylinder head. Further, the spacer may be configured and intended for properly mounting the intake manifold to an engine block, in particular the cylinder head of the engine. In the engine, at least one spacer may be provided. In general, the number of spacers used in the engine may depend on or correspond to the number of intake manifolds or number of cylinders of the engine.

As set forth above, the spacer is provided with at least one air-accumulation cavity, also referred to as "the cavity" in the following. The cavity may be designed and configured to prevent intake air present in the cavity from being discharged from the intake duct. Alternatively or additionally, the cavity may be designed and configured to prevent the cavity from being supplied with a fluid from outside the intake duct. Alternatively or additionally, the cavity may constitute a section of the intake duct which hermetically seals the intake duct from an outside of the intake duct.

Further, the spacer may be provided such that, in a mounted state of the spacer in which the spacer is installed in the engine and during operation of the engine, the spacer is configured to prevent a mass flow of a gas stream flowing through the intake duct from being increased or decreased upon flowing through the spacer.

In a further development, the cavity may be designed such that it is tuned to a frequency of vibrations generated in the intake duct or waves propagating through the intake duct upon operation of the engine. Specifically, the cavity may form a Helmholtz resonator.

For fluid-communicatively connecting the cavity to the flow-through passage, the spacer may be provided with at least one communication conduit. In other words, the cavity is fluid-communicatively connected to the flow-through passage by means of the at least one communication conduit. Optionally, the fluid conduit may be provided such that it opens into the flow-through passage and/or the cavity in a direction that is perpendicular or substantially perpendicular to a flow direction of intake air to be fed through the flow-through passage in a mounted state.

In a further development, the spacer may be provided with a cavity which is fluid-communicatively connected to or which opens into at least two different and separately provided flow-through passages. Specifically, the cavity may be connected to a first flow-through passage by means of a first communication conduit and to a second flow-through passage by means of a second communication conduit. Optionally, the first and the second communication conduits may be arranged on opposed sides of the cavity. In this way, a compact design of the spacer may be provided.

The spacer may comprise at least two cavities, for example three or more cavities. Alternatively or additionally, the spacer may comprise at least two flow-through passages. The number of flow-through passages may correspond to or depend on a number of cavities provided in the spacer. By providing a plurality of cavities, in particular the number of which depends on the number of provided flow-through passages in the spacer, the vibration characteristics of the intake duct may be changed in a more effective and more precise way. Further, the number of flow-through passages may correspond to a number of cylinders the engine.

For example, the spacer may comprise a number of n flow-through passages and a number of n−1 cavities, wherein n is a natural number greater than or equal to two. In such a configuration, each one of the cavities may be arranged between two different and separately provided flow-through passages. In this way, a compact design of the spacer may be provided.

In a further development, the spacer may be provided as an integral part. Alternatively, the spacer may be provided in the form of an assembly which is built up from more than one part. Specifically, the spacer may comprise or consist of at least two parts. In this way, the spacer may contribute to an improved or simplified manufacturing and/or maintenance process.

Specifically, the spacer may comprise or consist of a spacer plate and at least one gasket which, in an assembled state of the spacer in which the spacer plate and the gasket are mounted to one another, are connected to one another or fit tightly against each other at correspondingly designed front surfaces. In this configuration, the at least one cavity may be delimited by both the spacer plate and the gasket.

In a further development, the spacer plate may be provided with at least one recess which extends from a front surface of the spacer plate in a thickness direction thereof. The at least one recess may form the at least one cavity and/or the at least one communication conduit. By such a configuration, manufacturing of the spacer may be improved and/or simplified.

Furthermore, an internal combustion engine may be provided which has an air intake system being equipped with a spacer as described above.

INDUSTRIAL APPLICABILITY

With reference to the Figures and their accompanying description, a spacer for use in an air intake system of an internal combustion engine and an internal combustion engine being equipped with such a spacer are suggested. The spacer as mentioned above is applicable in any internal combustion engine, in particular in reciprocating engines. The suggested spacer may replace conventional spacers and may serve as a replacement or retrofit part.

What is claimed is:

1. A spacer for use in an air intake system of an internal combustion engine for delimiting an intake duct between an intake manifold and a cylinder head of the engine, wherein the spacer is provided with at least one flow-through passage and at least one air-accumulation cavity which are fluid-communicatively connected and constitute the intake duct, where the at least one air-accumulation cavity is designed and configured to prevent the at least one air-accumulation cavity from being sup lied with a fluid from outside the intake duct.

2. The spacer according to claim 1, wherein the cavity is designed and configured to prevent intake air present in the cavity from being discharged from the intake duct.

3. The spacer according to claim 1, wherein the cavity is designed and configured to prevent the cavity from being supplied with a fluid from outside the intake duct.

4. The spacer according to claim 1, wherein the cavity constitutes a section of the intake duct which is hermetically sealed from an outside of the intake duct.

5. The spacer according to claim 1, wherein in a mounted state of the spacer in which the spacer is installed in the engine and during operation of the engine, the spacer is configured to prevent a mass flow of a gas stream flowing through the intake duct from being increased or decreased upon flowing through the spacer.

6. The spacer according to claim 1, wherein the cavity is designed such that it is tuned to a frequency of vibrations generated in or of waves propagating through the intake duct upon operation of the engine.

7. The spacer according to claim 1, wherein the cavity is fluid-communicatively connected to the flow-through passage by means of a communication conduit which opens into the flow-through passage in a direction that is perpendicular to a flow direction of intake air to be fed through the flow-through passage in the mounted state.

8. The spacer according to claim 1, wherein the cavity is fluid-communicatively connected to or opens into at least two flow-through passages.

9. The spacer according to claim 1, wherein the cavity is connected to a first flow-through passage by means of a first communication conduit and to a second flow-through passage by means of a second communication conduit, wherein in particular the first and the second communication conduits are arranged on opposed sides of the cavity.

10. The spacer according to claim 1, comprising at east two cavities and at least two flow-through passages.

11. The spacer according to claim 1, comprising a number of n flow-through passages and a number of n−1 cavities, wherein a is a natural number greater than or equal to two.

12. The spacer according to claim 10, wherein each one of the two cavities is arranged between two different flow-through passages.

13. The spacer according to claim 1, comprising or consisting of a spacer plate and a gasket which, in an assembled state of the spacer, are connected to one another or fit tightly against each other at correspondingly designed front surfaces, wherein the at least one cavity is delimited by both the spacer plate and the gasket.

14. The spacer according to claim 13, wherein the spacer plate is provided with a recess which extends from a front surface of the spacer plate in a thickness direction of the spacer plate and which forms at least one of the cavity and the communication conduit.

15. The internal combustion engine having an air intake system which is equipped with a spacer according to claim 1.

* * * * *